US008230977B2

(12) United States Patent
Thumm et al.

(10) Patent No.: US 8,230,977 B2
(45) Date of Patent: Jul. 31, 2012

(54) DISTRIBUTED CONTROL SYSTEM FOR AN ELEVATOR SYSTEM

(75) Inventors: Gerhard Thumm, Filderstadt (DE); Markus Hänle, Erkenbrechtsweiler (DE)

(73) Assignee: Thyssenkrupp Elevator AG, Dusseldorf (DE)

( * ) Notice: Subject to any disclaimer, the term of this patent is extended or adjusted under 35 U.S.C. 154(b) by 477 days.

(21) Appl. No.: 12/448,256

(22) PCT Filed: Jul. 8, 2008

(86) PCT No.: PCT/EP2008/005535

§ 371 (c)(1),
(2), (4) Date: Jun. 15, 2009

(87) PCT Pub. No.: WO2009/018886

PCT Pub. Date: Feb. 12, 2009

(65) Prior Publication Data

US 2009/0277724 A1 Nov. 12, 2009

(30) Foreign Application Priority Data

Aug. 7, 2007 (EP) ..... 07015475

(51) Int. Cl.
*B66B 1/28* (2006.01)

(52) U.S. Cl. ..... 187/247; 187/249; 187/391

(58) Field of Classification Search ..... 187/247, 187/248, 249, 289, 293, 296, 297, 391–394
See application file for complete search history.

(56) References Cited

U.S. PATENT DOCUMENTS 4,473,133 A * 9/1984 Enriquez et al. ..... 187/247
4,872,532 A 10/1989 Tobita et al.
5,202,540 A * 4/1993 Auer et al. ..... 187/247
5,360,952 A * 11/1994 Brajczewski et al. ..... 187/248
5,654,531 A * 8/1997 Farabee et al. ..... 187/247
5,663,538 A 9/1997 Sakita
5,848,669 A * 12/1998 Park ..... 187/247
5,877,462 A * 3/1999 Chenais ..... 187/249
6,173,814 B1 * 1/2001 Herkel et al. ..... 187/288
7,178,635 B2 * 2/2007 Meissner et al. ..... 187/249
7,353,914 B2 * 4/2008 Deplazes ..... 187/313
7,487,860 B2 * 2/2009 Hikita et al. ..... 187/249
7,896,135 B2 * 3/2011 Kattainen et al. ..... 187/248
7,918,320 B2 * 4/2011 Kondo et al. ..... 187/288
8,020,668 B2 * 9/2011 Hsu et al. ..... 187/249

(Continued)

FOREIGN PATENT DOCUMENTS

EP 1 679 279 A1 1/2005

(Continued)

*Primary Examiner* — Anthony Salata
(74) *Attorney, Agent, or Firm* — Shlesinger, Arkwright & Garvey LLP

(57) ABSTRACT

An elevator system including an elevator shaft and at least one elevator cab which can move in the elevator shaft. The elevator system has a distributed control system having a first evaluation unit, respectively associated with the at least one elevator cab, and has at least one second evaluation unit, associated with the elevator shaft. A bus link connects the first evaluation unit and the at least one second evaluation unit to one another. The first evaluation unit has a set of limit curves containing limit curves for the actuation of a braking device and/or a safety gripping device that are calculated and scaled in line with a current operating state, the first evaluation unit being configured to trigger the safety gripping device or the braking device if one of the limit curves is exceeded. Defined ends of the limit curves limit a scope of movement for the at least one elevator cab.

29 Claims, 6 Drawing Sheets

U.S. PATENT DOCUMENTS

| | | | |
|---|---|---|---|
| 2003/0217893 | A1 | 11/2003 | Dunser et al. |
| 2004/0178024 | A1 | 9/2004 | Deplazes et al. |

FOREIGN PATENT DOCUMENTS

| | | | |
|---|---|---|---|
| EP | 1 621 504 | A1 | 2/2005 |
| EP | 1 864 934 | A1 | 12/2007 |
| JP | 02-075583 | | 3/1990 |
| KR | 930009006 | | 8/1990 |
| WO | WO 00/51929 | | 9/2000 |
| WO | WO 02/098778 | A1 | 12/2002 |
| WO | WO 2006/106574 | A1 | 10/2006 |

* cited by examiner

DISTRIBUTED CONTROL SYSTEM FOR AN ELEVATOR SYSTEM

RELATED APPLICATIONS

This is a national stage application of International PCT Application No. PCT/EP2008/005535, with international filing date of Jul. 8, 2008, claiming the priority benefit of European Patent Application No. EPC 07 015 475.2, filed on Aug. 7, 2007, both of which are hereby incorporated by reference.

The present invention relates to an elevator system with an elevator shaft and at least one elevator cab which can move in the elevator shaft. In particular, the present invention relates to an elevator system with a distributed or decentralized elevator controller with safety-oriented identification and processing of signals and data sensed in the elevator system.

Elevator systems with distributed or decentralized control concepts have been known for many years in the field of elevator design. A typical elevator controller of this kind comprises a signal and data sensing device in an elevator cab which is connected by wire to an operator console, which is usually arranged and externally accessible in a region of the topmost station in the elevator shaft. Besides an on/off switch, the operator console contains any devices required for initiating emergency measures. Often, the operator console is connected for communication purposes to a central control room, which may be located inside or outside of the building. Furthermore, there is also wiring between the operator console and the drive motor with a frequency converter in the elevator shaft and for the elevator car. It is equally usual to have a wire link between the operator console and safety devices at the stations and in the pit of the elevator shaft.

U.S. Pat. No. 5,360,952 discloses an elevator system with an LAN elevator network. This network comprises a pair of redundant field buses for exchanging signals with an elevator control system, a pair of redundant group buses for exchanging signals between individual elevators and a pair of redundant building buses for message exchange with a building controller. All the nodes of the individual buses communicate with one another using a single protocol. This arrangement is based on the problem of reducing the average communication time for a message between different nodes in an LAN elevator network.

KR 9309006 (Abstract) discloses the practice of equipping an elevator with a signal transmission system which comprises a bus transceiver for converting the 8-bit address signals of the CPU into data signals and a data communication interface for receiving serial 8-bit data signals, which is intended to simplify the installation of signal transmission lines and to reduce the installation costs.

JP 02075583 A (Abstract) discloses an elevator arrangement in which the number of communication lines is reduced by connecting the individual elevators by means of a serial transmission path via buses.

In modern, complex elevator installations, the substantial flow of signals with safety-related signals results in very high efforts for wiring which, particularly in very modern elevator installations in which two or more elevator cabs are moved and controlled independently of one another in a shaft, becomes very complex and a significant cost factor.

In contrast thereto, the invention proposes an elevator system having an elevator shaft and at least one elevator cab which can move in the elevator shaft, which elevator system also comprises a control system which, in line with the invention, is of safety-oriented design.

The elevator system comprises a number of safety assemblies which are connected to one another by means of a bus link, so that signal interchange between the safety assemblies is possible via the bus link.

The safety assemblies are associated with different regions of the elevator system and have signal inputs which can be used to safely receive signals, for example from safety switches or sensors. These signals can either be safely read in as safe, nonredundant signals, or they can be read in as nonsafe redundant signals and processed further on the safety assembly to form a safe signal. An interface for the bus link connects the safety assemblies to the bus link.

Together with the number of safety groups, the bus link therefore forms a virtual safety loop which replaces and functionally extends the previously known, discretely wired safety loop of known elevator systems. In contrast to this known, discretely wired safety loop, which has series-connected safety switches which interrupt the safety loop in the event of a safety switch being open, the safety switches in the virtual safety loop are connected to the respective safety assembly in parallel. There, the incoming signals are processed and are evaluated in line with a current defined operating state, for example, or a particular measure is triggered in line with the results of the evaluation.

The use of the virtual safety loop results not only in the advantage of the reduced wiring sophistication but also in more information, since, in the event of serial bit data being used, it is now known to which switch a fault can be attributed. This achieves an improved opportunity for diagnosis and allows differentiated reactions to faults.

By way of example, the safety assemblies comprise a first safe evaluation unit and a second safe evaluation unit, the first safe evaluation unit being associated with the at least one elevator cab of the elevator system, and the second safe evaluation unit being associated with the elevator shaft, for example the upper station of the elevator shaft. Furthermore, the safety assemblies comprise third evaluation units, which may be associated with the individual stations for the elevator cab.

The safety assemblies respectively comprise not only the interface for the bus link but also data inputs for safely sensing the signals from safety switches or sensors and data outputs for safely controlling a braking device and a safety (gripping) device, for example. Furthermore, the safety assemblies may each have a nonsafe subregion for evaluating the nonsafe signals. The first evaluation unit additionally comprises an interface for redundantly sensing signals from sensors for, by way of example, the position and speed of the elevator cab.

The safety assemblies, particularly the first and second evaluation units and the third evaluation units, are connected to one another by means of the bus link, with signal transmission via the bus link being effected using a safety protocol, so that safety-related data transmission is possible between the safety assemblies. The same bus link can also be used at the same time to transmit nonsafe data using a nonsafe protocol.

Within the context of the present application, an evaluation unit or another programmable device is "safe" if it complies with DIN EN ISO 61508. Preferably, the term "safe" is understood to mean a device which at least complies with safety integrity level SIL 3 in said standard.

In line with the invention, bus links for transmitting data in the elevator controller are therefore of safety-related design. The data transmission is effected using a safety protocol which ensures that possible transmission errors are detected and are reconstructible and that any data corruption is indicated, so that it is also possible for safety-related data to be transmitted via the bus link.

The embodiment according to the invention achieves a significant reduction in the wiring sophistication in modern elevator installations. This has a particular effect in elevator installations with greater lift heights and in elevator installations with two or more elevator cabs per shaft, in which, to date, safety-related data were transmitted exclusively by means of discrete wiring since otherwise there was no way of controlling the at least two elevator cars in safety-oriented fashion, but independently of one another.

A bus link within the context of the present application is a link for transmitting data and signals between a plurality of functional units in a technical installation which each have a processor-assisted data processing device. The design of the bus link is at the discretion of a person skilled in the art, and he is able to resort to a multiplicity of known design options. By way of example, a bus link within the context of the invention is in the form of a serial bus link. The link can be produced by means of physical wires or may alternatively be in wireless form. As a further variant, the link can also be modulated onto a wire or cable which is present anyway, for example a power cable (e.g. 240-volt cable). Furthermore, the bus link may have a bus controller, depending on the design. The design of interfaces which are required is also known to a person skilled in the art. It should be emphasized that, within the context of the invention, a distinction needs to be drawn, in principle, between a safe bus link, which, in line with the invention, operates using a suitable safety protocol, and a "normal" bus link without special demands on the safety of uncorrupted data transmission. The invention involves these systems being integrated to form a safe link.

The safety assemblies are in a form such that they could read and process signals from the connected sensors. The results can be sent to further safety assemblies via the bus link. Specifically the first evaluation unit can determine a safe position and a safe speed for the elevator cab, for example, using the sensors and can monitor the current position and speed in line with defined presets for a current operating state. Furthermore, it can also monitor and actuate the safety switches, an inspection controller and what is known as an electrical return controller. In general, the safety assemblies are also able to prompt specific stopping and/or an immediate stop or an emergency stop for the elevator cab for defined events by triggering the braking device or the safety gripping device using trigger signals to the relevant apparatus. In this case, the trigger signals can be transmitted by means of the bus link, for example, or can be sent directly to the braking and safety gripping apparatuses, if these are connected, in line with a further embodiment of the elevator system, directly to data outputs of the respective safety assembly or specifically of the first trigger unit and the second trigger unit.

The safety gripping device may comply with the standards EN81-1, 9.8 and 9.9, for example, and comprises a governor speed limiter, which may be a further safety assembly and processes the trigger signals received from the other safety assemblies, and a safety gripping apparatus. The speed limiter can trigger the stoppage of the elevator drive either in response to this received trigger signal or else if the speed of the elevator cab differs from a defined trigger speed for the speed limiter.

In the event of an emergency stop, the drive and the brakes of the elevator cab are decoupled from the power supply, which switches off the drive and actuates the brake. The emergency stop can be triggered on the basis of a safety switch being open, for example, by the associated safety assembly, or by the first or second evaluation unit on the basis of certain events.

Furthermore, if the speed of the elevator cab differs upward or downward from a defined trigger speed, what is known as emergency braking can be performed. This allows controlled stoppage of the elevator cab with higher deceleration than occurs during normal operation or with lower deceleration than the deceleration in an emergency stop or when the safety gripping device is used.

In line with another embodiment of the present elevator system, each of the safety assemblies can respectively comprise two independent interfaces for bus links. The individual bus link described can therefore also be in the form of a redundant duplicated bus link with two individual bus links or channels, the channels being able to transmit identical signals. The safety assemblies have a number of processors corresponding to the number of channels, so that the plurality of signals arriving via the different channels simultaneously can be read and processed by the processors. This allows a cross-check between the interim and final results of the processed signals, with each processor being able to trigger certain events independently of the results and independently of the other processor. These events may be the triggering of the braking device or of the fall-arresting device by at least one of the processors in their respective safety assembly, for example.

For processing the signals, predefined limit values are stored in an internal memory in the safety assemblies. The first evaluation unit is additionally used to store a set of limit curves, which are calculated in line with the current operating state. By way of example, this set of limit curves comprises a limit curve for the triggering of the braking device (trigger limit curve for the braking device) and a limit curve which defines the stopping point for the elevator cab when the braking device is operated (stopping limit curve for the braking device). Furthermore, the set of limit curves comprises a limit curve for the triggering of the safety gripping device (trigger limit curve for the safety gripping device) and a limit curve which defines the stopping point for the elevator cab when the safety gripping device is operated (stopping limit curve for the safety gripping device). The individual limit curves respectively describe a speed profile over the length (or height) of the elevator shaft and therefore associate a maximum speed value with each position in the travel of the elevator cab. The first evaluation unit reads in the redundant speed and position signals provided by the relevant sensors and uses these signals to determine the safe speed and the position of the elevator cab. On the basis of the current operating state, the first evaluation unit selects the appropriate trigger limit curve and checks whether it is being exceeded.

If the current speed of the elevator cab exceeds the speed limit value prescribed at the current position in the elevator shaft by the limit curve for the triggering of the safety gripping device or the braking device, the respective apparatus is operated within a defined reaction time. The elevator cab is therefore stopped within the respective stopping limit curve, said curve prescribing the stopping point when the respective apparatus is operated.

In line with another embodiment, the second evaluation unit can likewise perform a check on the evaluation calculations of the first evaluation unit. To this end, the second evaluation unit is also equipped with the functions described for the first evaluation unit and with the stored limit values and limit curves, and the data evaluated by the first evaluation unit are transmitted to the second evaluation unit.

In this way, it is possible to ensure that, in the event of a safety-related malfunction, that is to say in the event of an excessive speed for the elevator cab at the ascertained position, for example, appropriate safety devices are actuated by one of the two evaluation units in order (in the instance of said example) to actuate the braking device of the elevator system and/or to trigger the safety gripping device of the elevator system. To this end, the first and/or the second evaluation unit is/are connected for communication purposes to the safety devices and allow the safety devices to be read in onto the evaluation units. A suitable control apparatus circuit is described in EP 1 679 279 A1 from the same applicant, for example. With the safety ascertained position and speed of the elevator cab, the controller according to the invention is thus able to use the described limit curves for position and speed to replace the usually required limit switches, inspection limit switches, deceleration control circuits, door zone monitors, sag or drop prevention devices and elevator cab and counterweight buffers with (certificated) safe software evaluations.

It is equally possible to safely recognize when the elevator cab has left the station in an uncontrolled fashion, so to speak, and to initiate suitable measures. This may mean that in the event of assemblies failing, attempts are not (exclusively) made to attain the safe state for an elevator by switching off the drive and applying the brake, as is common practice today. If there is a fault in the brake, switching off the drive results in the elevator cab trundling away from the station and a dangerous excessive speed quickly being reached, particularly in the upward direction. In this case, safe software evaluation in accordance with the invention can result in an increase in safety by switching on the drive again after a dangerous situation of this kind has been recognized, in contrast to today's practice, and bringing the elevator cab specifically to the terminal station to which it would also be pulled by weight ratios. At this terminal station, either the elevator cab or the counterweight is put onto a fixed limit stop, which results in a safe state being achieved again. If there are people in the elevator cab, further suitable measures need to be taken, according to the load situation, so as not to bring about a fresh dangerous state as a result of reversal of the load ratios.

In one possible embodiment, a normal mode, an inspection mode or an electrical return mode, for example, can be defined as operating states.

In normal mode, the trigger limit curve for the braking device ends at the position of the virtual limit switches, and the profile of the trigger curve is calculated using a maximum nominal speed which occurs during normal operation. As illustrated above, this profile describes a particular maximum speed profile for the approach of the elevator cab to the virtual limit switches. In contrast to the customary limit switches today, this triggers the emergency stop earlier than in conventional elevator systems when the trigger limit curve is exceeded. Should the emergency stop not slow down the elevator cab to a specific extent, the safety gripping device is triggered. This guarantees that the elevator cab cannot move beyond the stopping limit curve for the safety gripping device, since the safety gripping device is a certificated safety assembly.

While the elevator cab is at a station in normal mode, the limit curves are scaled such that the trigger limit curve and the stopping limit curve for the braking device are limited by the door zone. The limit curves are calculated using a readjustment speed or what is known as a "relevelling speed" in this case. This describes the maximum speed which is used to readjust the position of the elevator cab. This readjustment becomes necessary in the event of load changes, as occur when passengers get in and out at the station, for example. Depending on the length and the diameter of the elevator cab's support cable, the cable stretch alters, which means that the elevator cab is not flush with the aperture at the station and hence a step may result.

In inspection mode, the limit curve for triggering the braking device ends at the positions of the virtual inspection limit switches. In line with the present invention, these replace the customary inspection limit switches which are usually located at these positions. These defined ends of the limit curves can be used to limit the scope of movement of the elevator cab, so that in inspection mode a sufficiently large space is ensured within the shaft between a nearby shaft end and the elevator cab for the servicing personnel. The relevant limit curve for the inspection mode is calculated using the maximum speed for the inspection mode. As described above, this profile also prescribes a particular maximum speed profile for the approach to the virtual inspection limit switches. In contrast to the customary inspection limit switches today, this triggers the emergency stop earlier than in conventional elevator systems when the trigger curve is actually exceeded. If the emergency stop does not slow down the elevator cab to a sufficient extent, the safety gripping device is triggered. This guarantees that the elevator cab cannot move beyond the stopping limit curve for the safety gripping device, since the safety gripping device is a certificated safety assembly. By contrast, the conventional inspection limit switches in today's elevator systems are not safety assemblies or safety switches, since this solution always necessitates a safe virtual inspection limit switch. If the elevator cab is stopped at the position of the virtual inspection limit switches, it cannot be moved on in the direction of the nearby shaft end, but rather can be moved on exclusively in the opposite direction. The effect achieved by this is that a sufficiently large space for the servicing personnel is maintained between the shaft end and the elevator cab.

In electrical return mode, the limit curves are calculated using a maximum return speed, with the limit curves not being limited by limit switches. In electrical return mode, the elevator cab is moved by means of an electrical return controller. This is operated by means of the elevator's customary power supply and can additionally be connected to a standby power supply so as to be able to be operated in emergency situations too.

The electrical return mode and individual test states are the only operating states in which the elevator cab can be moved beyond the position of the virtual limit switches. In these operating states, the limit curves do not describe an arc shape but rather describe essentially rectilinear curves which allow the elevator cab to move up to the buffers at what is known as an electrical return speed or allow the elevator cab to move beyond the limit switch.

As illustrated above, the elevator cab in the elevator system contains a first safe evaluation unit. In the case of an elevator system with two or more elevator cabs moving independently of one another in an elevator shaft, each of the elevator cabs may have a first safe evaluation unit of this kind. Furthermore, a second safe evaluation unit is provided which is associated with the elevator shaft and is connected to an operator console (intervention panel) (in the form of a man/machine interface), for example. The first evaluation unit in the elevator cab may similarly be connected to a cab console (cab operation panel) in the form of a man/machine interface. In the case of an elevator system with a plurality of elevator shafts, each elevator shaft preferably has a dedicated second evaluation unit.

As described, the first evaluation unit associated with the at least one elevator cab may, in line with the invention, be connected to sensors for safely sensing the position of the elevator cab. A suitable system for safely determining the state of movement of an elevator cab is described in EP 1 621 504 A1 of the same applicant, for example. On the basis of the signals provided by the sensors for safe position sensing, the first evaluation unit calculates the speed of the elevator cab at the ascertained position and evaluates whether this speed is within a described range. Furthermore, the evaluated data are transmitted to the second evaluation unit which is connected to an operator console, as serial bit data via the safe bus link provided in line with the invention. In addition, the second evaluation unit may be connected to an external control room or a control center, for example (in this context, the term "control center" is intended to be understood to mean any possible or appropriate central device connected to an elevator system, that is to say, by way of example, an emergency control center, a remote servicing control center, a buildings management control center, etc.).

The described transmission of the evaluated data from the first evaluation unit to the second evaluation unit can be used, in line with the invention, by the second evaluation unit to perform the described check on the evaluation calculations of the first evaluation unit in the elevator cab.

The safety-oriented transmission of the data via the bus link according to the invention using a safety protocol means that the second evaluation unit is able to track exactly at what point in the elevator system a malfunction occurs. This is done with essentially reduced cabling sophistication, which is very advantageous particularly in the case of a modern elevator system with a plurality of elevator cabs moving independently of one another in an elevator shaft. In particular, the invention can be used to control any elevator cab independently of remaining elevator cabs in the same elevator shaft and to move each of the remaining elevator cabs in a section of the elevator shaft which is at least currently unused by the respective other elevator cabs. This allows in case of a malfunction which occurs only on one elevator cab that the affected elevator cab be clearly identified and suitable measures (such as triggering of the braking device or of a safety gripping apparatus in extreme cases, for example) be initiated without the need for operation of the remaining, that is to say unaffected, elevator cab(s) to be stopped completely. If, as an example, the lower of two elevator cabs in an elevator shaft is frozen at an ascertained position (e.g. on the third floor), the elevator cab above it can still serve the remaining floors above the frozen position of the lower elevator cab. To attain such functionality with conventional control engineering, immense wiring sophistication would be required which, in the case of complex elevator systems with a plurality of elevator shafts and a multiplicity of floors, would have very high associated costs.

The elevator cab does not need to be immediately frozen in all situations in which malfunctions occur. Often, a change in the actuation of the elevator cab suffices. Thus, when a shaft door is no longer locked, the elevator cab can still be moved in the region below this door and can still make evacuation journeys there in emergency situations, in particular, since the position of the door which is no longer locked is known with the aid of the additional safety assemblies in situ. In one refinement, the elevator cab can be moved to the station beneath the shaft door which is no longer locked, which can reduce the risk of injury as a result of falling into the shaft.

In yet other cases, safety devices need to be actuated which are arranged in a shaft pit of the elevator shaft, for example. This actuation can also be effected using the second evaluation unit. It goes without saying that a communication link between the third evaluation unit and the safety devices is conceivable which allows information to be read in from the safety devices onto the third evaluation unit.

If, as described above, more than one elevator cab is provided in the same shaft then, in line with another embodiment, an apparatus can be used for preventing collisions. This apparatus ensures that two adjacent elevator cabs do not collide and sufficient space is made available to a person situated on the roof in the event of a relative approach by a second elevator cab from above. To achieve this, each elevator cab has a respective safety zone whose observance is ensured by means of the braking device or the safety gripping device. To this end, the respective first evaluation units of the various elevator cabs are connected to one another by means of the safe bus link. The safe bus link is used by the respective first evaluation units to exchange the limits of the associated safety zones. As soon as a safety zone for a first elevator cab overlaps a safety zone for a second elevator cab, the respective braking device and/or the safety gripping device of one or both elevator cabs is triggered.

If an elevator cab loses its connection to the safe bus link, the elevator cab in question is stopped by means of an emergency stop or the safety gripping device. The elevator cab remains within its safety zone so that the other elevator cabs can be moved to the nearest station, for example, so as to be immobilized there. Passengers in the elevator cabs are thereby able to leave the respective elevator cabs without being locked in. The apparatus for collision prevention is an additional apparatus but one which in no way replaces the trigger limit curves described. It also ensures that the interval between the elevator cabs can never become zero, even in return mode.

Another possible embodiment relates to monitoring the shaft doors. If the elevator is in normal mode and the shaft door is unlocked and opened manually by an engineer, for example, there is usually the risk of people being able to fall into the shaft or being able to be injured by a passing elevator cab or falling objects. In this case, the elevator system described can be used to determine the shaft doors affected and to adapt the limit curves in suitable fashion, so that the elevator cab cannot pass the affected region. If the elevator cab is below the open shaft door, it is possible to continue to operate the elevator cab in normal mode. In this case, the travel is limited to the region beneath the open shaft door, however.

Another possible apparatus in the elevator system is the sag or drop prevention device. This is activated as soon as the elevator cab is stopped, for example. If this apparatus recognizes that the elevator cab has moved downward by a defined distance relative to the position at which the sag prevention device has been activated, the safety gripping device is triggered. If the elevator cab needs to be moved subsequently to a stop, it is first necessary to deactivate the sag prevention device.

The door zone monitoring at the station is provided in line with a further embodiment. By activating the door zone monitoring, the trigger limit curves for the braking and safety gripping apparatuses can be reduced to the region of an unlocking zone after the elevator cab has reached the desired position, for example. The unlocking zone describes a section of the elevator shaft in a region of a station in which the doors can be opened automatically while the cab is still approaching this station. It is thus possible for door opening to be initiated even before the elevator cab is in a position which terminates flush with the shaft door, so that the passengers are able to get out without delay. Should an unintentional movement by the elevator cab occur which exceeds the value of the unlocking zone, the braking device and/or the fall-arresting device is triggered. If the apparatus is activated while the elevator cab is being stopped outside of the unlocking zone, for example in inspection mode, the same device can monitor a zone corresponding to the values of the unlocking zone in order to safeguard the stopping position of the elevator cab.

The present description of the elevator system provided is given in an illustrative manner and purely by way of example with reference to an elevator system for a cable elevator. It goes without saying that the elevator system described can likewise be used in other types of elevator. These include particularly hydraulic elevators, linear drive elevators, and also cableless elevators and elevators without a counterweight.

The invention also comprises a computer program which is configured such that it can perform the inventive control measures and the inventive operation of an elevator system when it is executed on a computation device suitable for this purpose, and to a computer-readable medium with the computer program stored thereon. The instructions for the inventive control measures and for the inventive operation can also be implemented on a programmable logic unit, such as on what is known as an application-specific integrated circuit (ASIC) or what is known as a "field programming gate array" (FPGA). Such a programmable logic unit is therefore likewise the subject matter of the invention. In this context, a computation device is understood to mean any control unit, evaluation unit or any other computer connected to the elevator system.

Further advantages and embodiments of the invention can be found in the description and in the accompanying drawings. It goes without saying that the features cited above and the features which are yet to be explained below can be used not only in the respectively indicated combination but also in other combinations or on their own without departing from the scope of the present invention.

The invention is shown schematically with the aid of an exemplary embodiment in the drawing and is described in detail below with reference to the drawing.

DETAILED DESCRIPTION OF THE DRAWINGS

Figure 1:
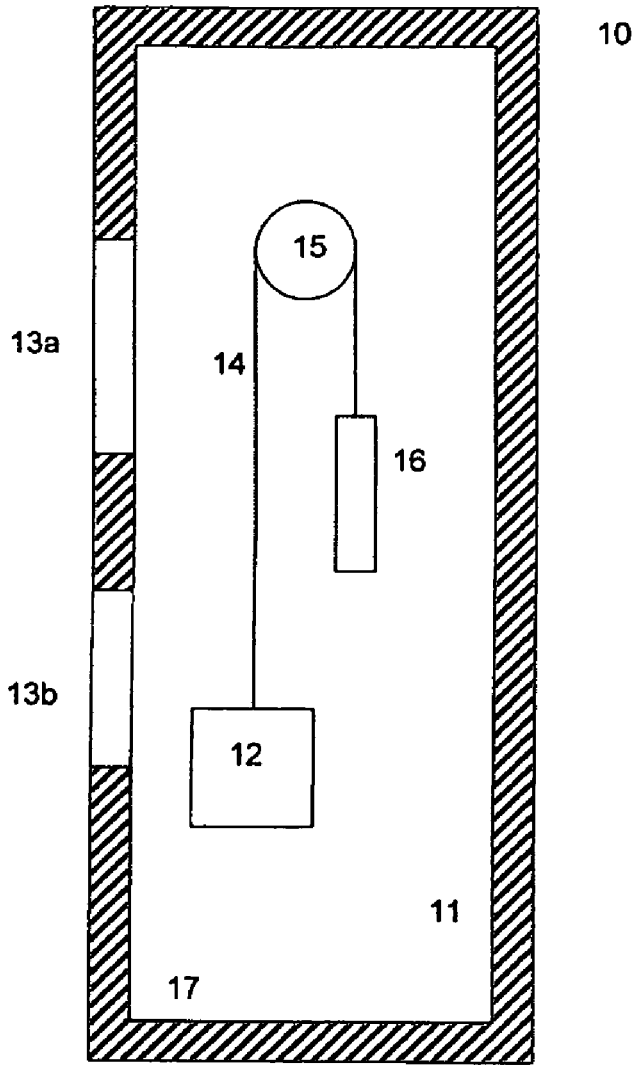
FIG. 1 shows a highly schematic illustration of an elevator system with an elevator shaft and an elevator cab which can move in the elevator shaft.

FIG. 1 shows an elevator system 10 with an elevator shaft 11 and an elevator cab 12 which can move in a vertical direction in the elevator shaft 11. The elevator cab 12 is connected to a drive 15 and a counterweight 16 by means of a support cable 14, the drive 15 driving the support cable 14, and the elevator cab moving upward or downward depending on the drive direction of the support cable 14. The counterweight 16 is moved in the opposite direction in corresponding fashion. The elevator shaft 11 also comprises a plurality of stations 13*a* and 13*b*. The elevator cab 12 can be stopped at said stations in order to allow passengers to get into and out of the elevator cab 12. The lower termination of the elevator shaft 11 is formed by the shaft pit 17.

Figure 2:
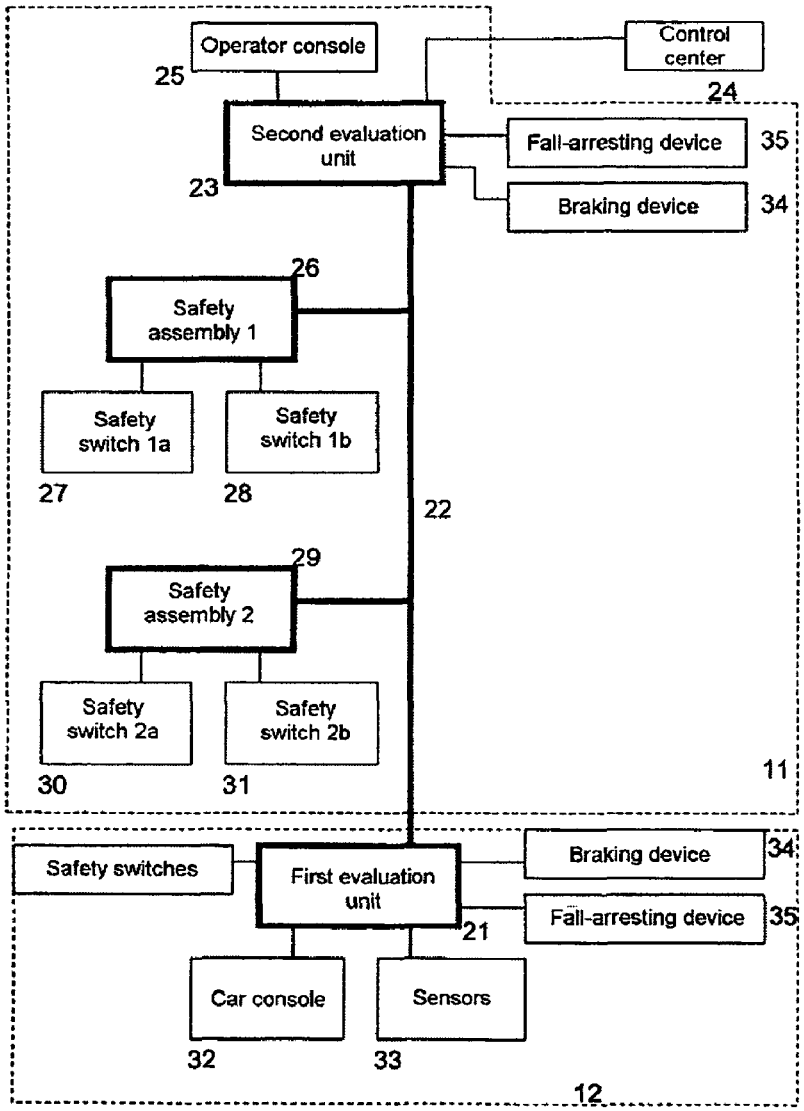
FIG. 2 shows a schematic block diagram of the inventive bus link between a first evaluation unit and a second evaluation unit.

FIG. 2 shows a schematic block diagram of a safe bus link 22 according to the invention. The safe bus link 22 is generally connected to a first evaluation unit 21, a second evaluation unit 23, with the first evaluation unit 21 being associated with the elevator cab 12 and the other components being associated with the elevator shaft 11. The first evaluation unit 21 has a cab console 32 as a man/machine interface, sensors 33 for determining the position and speed of the elevator cab, and optionally a safety gripping device 35 and a braking device 34 connected to it. From the signals from the sensors 33, the first evaluation unit 21 calculates the current position and speed of the elevator cab and compares them with stored limit curves and limit values. If a limit curve or the limit values is/are exceeded, the first evaluation unit triggers either the safety gripping device 35 or the braking device 34 in order to stop or slow down the elevator cab. The choice of the respective device triggered is dependent on the evaluation and a measure associated with the evaluation result. Furthermore, safety assemblies 26 and 29 are linked to the safe bus link 22. By way of example, they are associated with the individual stations 13*a* and 13*b* and each have a plurality of parallel-connected safety switches 27 and 28 or 30 and 31. The signals from the safety switches 27, 28, 30 and 31 are received and processed in the respective connected safety assemblies 26 and 29. In line with a predetermined measure, signals can be sent via the safe bus link 22 to the other components connected to the safe bus link 22. By way of example, in this way it is possible to inform the first or second evaluation unit 21, 23 about open safety switches 27, 28, 30, 31 and take suitable countermeasures. Furthermore, the first and second evaluation units 21, 23 can exchange signals via the bus link 22, which means that the signals processed by the first evaluation unit 21 can be checked in the second evaluation unit 23, for example. The second evaluation unit 23 can also trigger the safety gripping device 35 of the braking device 34 as a measure in response to the check results. In addition, the second evaluation unit is connected to a control center 24.

Figure 3:
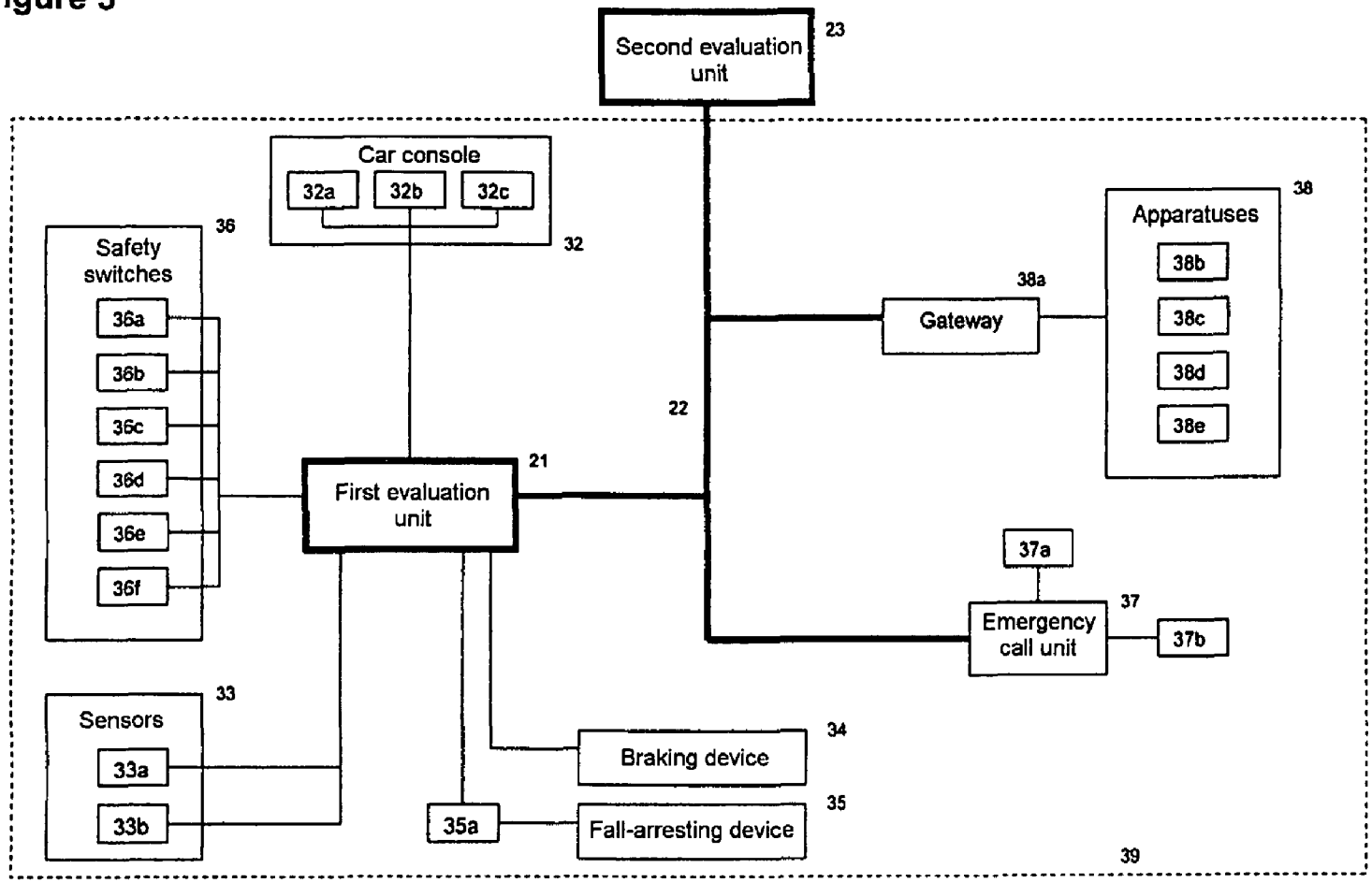
FIG. 3 shows a schematic block diagram of the first evaluation unit of the invention and the connection thereof to other components of the elevator system.

FIG. 3 shows a block diagram of a possible elevator cab subsystem 39 of the elevator system. The first evaluation unit 21 is coupled for communication purposes to the second evaluation unit 23, associated with the elevator shaft 11, by means of the safe bus link, as shown in FIG. 2. In the region of the elevator cab or within the elevator cab subsystem 39, the first evaluation unit 21 is connected to the cab console 32 which comprises a plurality of components such as an inspection limit switch 32*a*, an emergency off switch 32*b* and a control panel 32*c*. This can be used to control functions which are intended to be rendered accessible merely to the servicing personnel but not to the ordinary passenger. Furthermore, in the embodiment shown, a plurality of safety switches 36 are connected for communication purposes to the first evaluation unit 21, so that it is possible for the safety switches 36 to be read in onto the first evaluation unit 21. These safety switches 36 include, by way of example, a locking switch for the cab door 36*a*, a safety gripping switch 36*b*, a monitoring switch 36*c* for the roof of the elevator cab and a monitoring switch 36*d* for the handrail of the elevator cab. These safety switches monitor the state of the elevator cab and, in the event of irregularity or danger, send a signal to the first evaluation unit 21 which can initiate suitable measures. By way of example, the sensors 33 connected to the evaluation unit 21 comprise two sensors 33*a*, 33*b* for sensing the position of the elevator cab 21. Furthermore, the safe bus link 22 has an emergency unit 37 connected to it. This may comprise units for emergency signaling 37*a* and a speech converter 37*b*, for example, or other units which are necessary for producing an emergency call. What is known as a gateway 38*a* can be used to connect additional apparatuses 38 to the safe bus link 22. These include, by way of example, apparatuses for load measurement 38*b*, a door drive 38*c*, a voice announcement 38*d* and also control and display elements 38*e* for informing the passengers.

Figure 4:
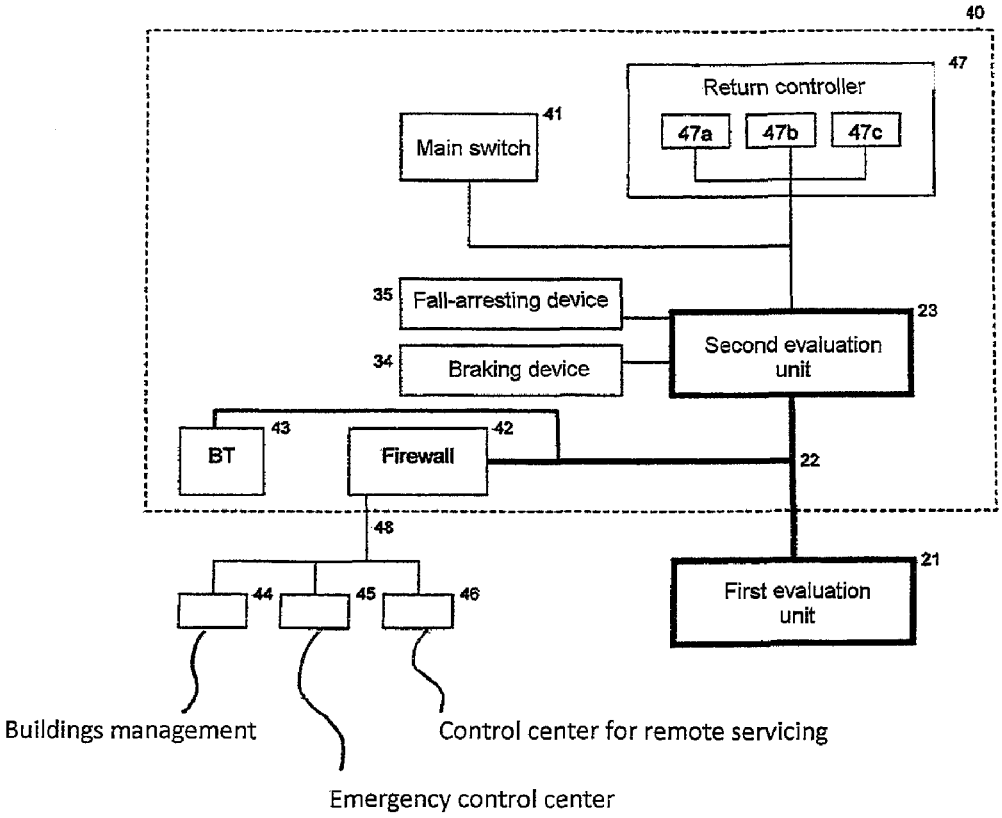
FIG. 4 shows a schematic block diagram of the second evaluation unit of the invention and the connection thereof to other components of the elevator system.

FIG. 4 shows a block diagram with a possible arrangement for the second evaluation unit 23 and the components connected thereto as a subsystem 40 of the elevator system. The second evaluation unit 23 is connected for communication purposes to the first evaluation unit 21, associated with the elevator cab 12, by means of the safe bus link 22, as shown in FIG. 2. In addition, the second evaluation unit 23 is coupled to a return controller 47, which comprises, by way of example, a return switch 47*a* for activating and deactivating the return mode and control switches 47*b*, 47*c* in order to move the elevator cab 12 upward and downward. Furthermore, a primary or main switch 41 is connected to the second evaluation unit 23 and allows the entire elevator system to be switched on and off. In line with one embodiment, the connection to external control centers 24 can be made by connecting what is known as a firewall 42. The latter is coupled to the safe bus link and forwards the signals from and to the external control centers. At the same time, the firewall 42 controls and protects the safe bus link in respect of inadmissible access operations from outside of the bus link. The safe bus link therefore ends at the firewall 42. By way of example, the external control centers comprise a control center for buildings management 44, an emergency control center 45 or a control center for remote servicing 46 of the elevator system and can be situated inside or outside of the building. Furthermore, what is known as a Bluetooth diagnosis node, which provides a wireless diagnosis function, can be linked to the bus link 22, for example.

Figure 5:
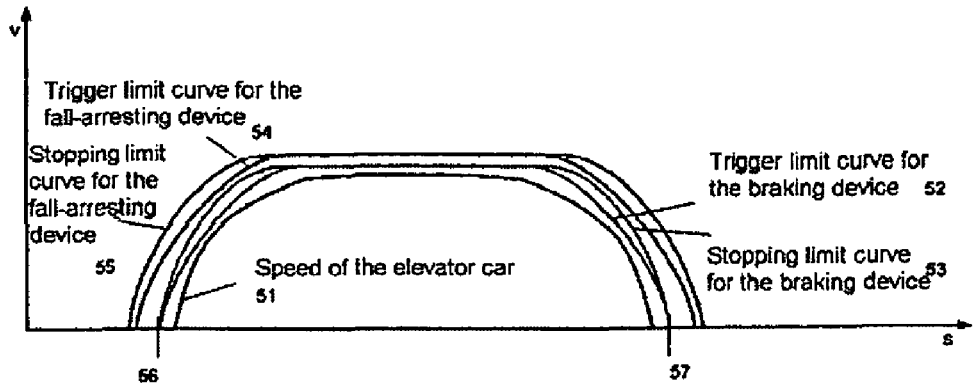
FIG. 5 shows the profile of various inventive limit curves which respectively define a particular speed profile over the height of the elevator shaft.

FIG. 5 shows an example of the profile of various inventive limit curves which each define a speed profile over the height s of the elevator shaft. A curve 51 shows the arcuate profile of the current speed of the elevator cab 12 and runs beneath a trigger limit curve 52 and a stopping limit curve 53 for the braking device. The trigger limit curve 52 and the stopping limit curve 53 of the braking device each end at a lower end 56 and an upper end 57. In this way, the elevator cab 12 is stopped at these positions in a normal mode and in an inspection mode. This means that real limit switches or inspection limit switches can be replaced virtually. If the curve 51 of the current speed profile exceeds the trigger limit curve 52 of the braking device, the braking device is triggered and slows down the elevator cab, so that the curve 51 of the current speed profile does not exceed the stopping limit curve 53 of the braking device. Should this case arise nevertheless, however, a trigger limit curve 54 for the safety gripping device and a stopping limit curve 55 for the safety gripping device are provided which enclose the previously described curves. If the curve 51 of the current speed profile exceeds the trigger limit curve 54 of the safety gripping device, the safety gripping device is triggered and the elevator cab is stopped within the stopping limit curve 55 of the safety gripping device.

Figure 6:
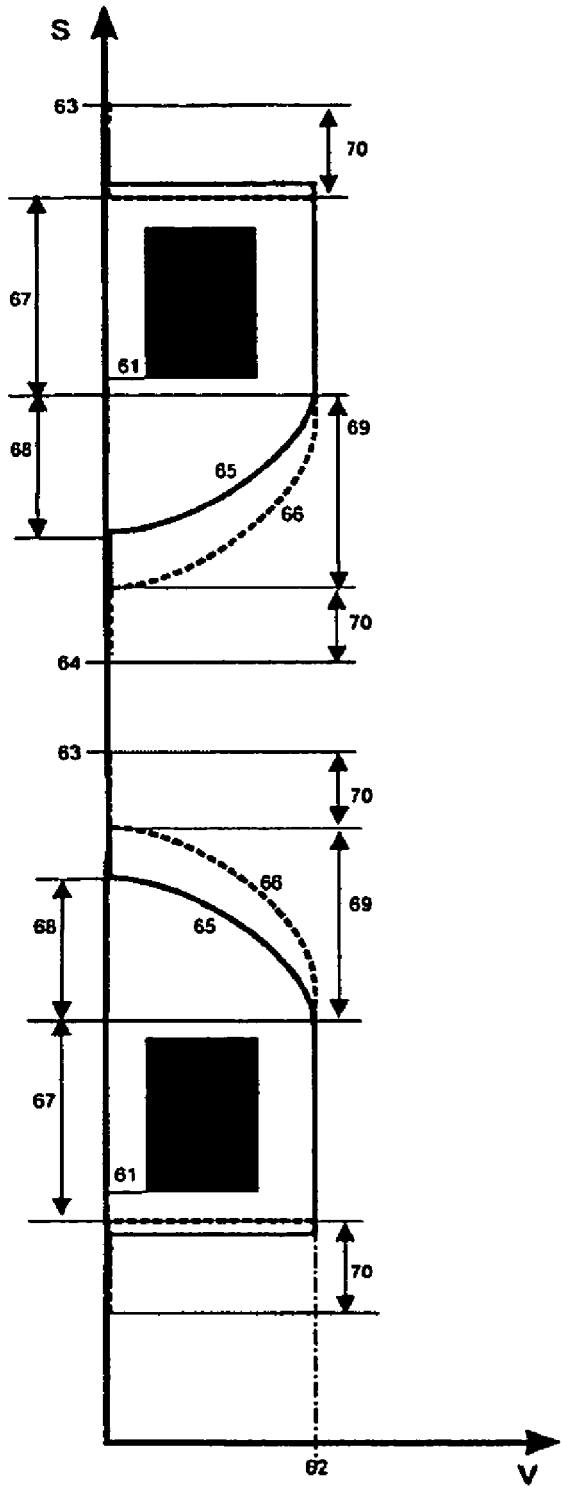
FIG. 6 shows the profile of limit curves when using two elevator cabs and an apparatus for collision prevention and also shows the safety zones associated with the elevator cabs.

FIG. 6 shows the profile of limit curves when using two elevator cabs and when using an apparatus for collision prevention and also shows the safety zones associated with the elevator cabs. The two elevator cabs are at the two current cab positions 61 at an arbitrary time and have a current speed 62. Each elevator cab comprises a safety region which ends at the top at the position 63 on the basis of the current speed 62 and is protected by the braking device. Beneath the elevator cab, the safety region ends at the position 64 on the basis of the current speed. The two positions 63 and 64 stipulate the ends of the safety regions which are required for stopping the elevator cabs and additionally maintaining a space between the two elevator cabs. To this end, the elevator cabs are slowed down by means of the braking device in line with stopping limit curves 65, so that they are at a sufficiently dimensioned interval from the respective end of the safety region. If the elevator cabs are not slowed down by the braking device, the safety gripping apparatus is triggered and the elevator cabs are immobilized in line with the stopping curves for the safety gripping apparatus 66. In this case too, there still needs to be sufficient space between the elevator cabs, and the elevator cabs need to be stopped at defined intervals from the respective ends 63 and 64 of the safety region. The distances 67 take into account the height of the elevator cabs between their topmost and bottom-most points. The distances 68 and 69 describe the respective distances which are required in order for the cab to be stopped by means of the safety gripping device or the braking device in the event of sudden triggering. In this case, the distances 70 indicate the remaining safety region for the respective elevator cab.

The invention claimed is:

1. An elevator system having an elevator shaft and at least one elevator cab which can move in the elevator shaft, the elevator system comprising:

a distributed control system having a first evaluation unit, respectively associated with the at least one elevator cab, and has at least one second evaluation unit, associated with the elevator shaft;

a bus link connecting the first evaluation unit and the at least one second evaluation unit to one another;

the first evaluation unit comprising a set of limit curves containing limit curves for the actuation of a braking device and/or a safety gripping device that are calculated and scaled in line with a current operating state, the first evaluation unit being configured to trigger the safety gripping device or the braking device if one of the limit curves is exceeded; and wherein defined ends of the limit curves limit a scope of movement for the at least one elevator cab.

2. The elevator system according to claim 1, wherein signal transmission takes place via the bus link using a safety protocol, so that safety-related data transmission is possible between the evaluation units, so that possible transmission errors are detected and reconstructible.

3. The elevator system according to claim 1, wherein two or more elevator cabs can move independently of one another in an elevator shaft, and wherein each elevator cab has an associated dedicated first evaluation unit.

4. The elevator system according to claim 2, wherein the safety protocol is in a form such that transmission errors are detected.

5. The elevator system according to claim 2, wherein the safety protocol is in a form such that data corruption is indicated.

6. The elevator system according to claim 1, wherein the first evaluation unit associated with the at least one elevator cab is connected to sensors for safe position and speed sensing for the elevator cab.

7. The elevator system according to claim 1, wherein the first evaluation unit associated with the at least one elevator cab is connected to sensors for safe acceleration sensing for the at least one elevator cab.

8. The elevator system according to claim 1, wherein the first evaluation unit associated with the at least one elevator cab is connected for communication purposes to at least one safety switch and allows the at least one safety switch to be read onto the first evaluation unit.

9. The elevator system according to claim 1, wherein the first evaluation unit associated with the at least one elevator cab is connected for communication purposes to at least one safety device of the elevator system and allows the safety device to be read onto the first evaluation unit.

10. The elevator system according to claim 1, wherein the braking device and the safety gripping device are actuated by the first evaluation unit and/or the at least one second evaluation unit.

11. The elevator system according to claim 1, wherein the at least one second evaluation unit is connected to an operator console in the form of a man/machine interface.

12. The elevator system according to claim 1, wherein the at least one second evaluation unit is connected to a drive of the elevator system.

13. The elevator system according to claim 12, wherein the at least one second evaluation unit is connected to a frequency converter of the drive.

14. The elevator system according to claim 1, wherein the at least one second evaluation unit is connected to safety devices in a pit of the elevator shaft.

15. The elevator system according to claim 1, wherein the at least one second evaluation unit is connected to an external control room or control center.

16. The elevator system according to claim 1, wherein the bus link is a serial bus link.

17. The elevator system according to claim 1, and further comprising additional evaluation units, wherein every one of the additional evaluation units is connected to the bus link for signal transmission purposes and allows actuation of safety devices of the elevator system.

18. The elevator system according to claim 17, wherein each one of the additional evaluation unit is connected for communication purposes to safety devices and allows the safety devices to be read onto the additional evaluation units.

19. The elevator system according to claim 17, wherein the bus link has at least two physically separate channels, and the first evaluation unit, the at least one second evaluation unit and the additional evaluation units are equipped with at least a number of processors which corresponds to the number of channels.

20. A method for controlling an elevator system, comprising the steps of:

a first evaluation unit calculating and scaling at least one limit curve in line with a current operating state, wherein the at least one limit curve associates an associated speed with an arbitrary position for an elevator cab in an elevator shaft;

controlling the elevator cab in line with the respective values of the at least one limit curve; and triggering by the first evaluation unit a safety gripping device or a braking device if one, of the at least one limit curve is exceeded, and defined ends of the at least one limit curve limiting a scope of movement for the elevator cab.

21. The method for controlling an elevator system according to claim 20, and further comprising the step of comparing the at least one limit curve with measured values from sensors for safely sensing the position and speed of the elevator cab.

22. The method for controlling an elevator system according to claim 20, and further comprising the step of introducing predefined safety measures in response to the comparison of the at least one limit curve with measured values from sensors for safely sensing the position and speed of the elevator cab.

23. The method for controlling an elevator system according to claim 20, wherein the at least one limit curve comprises at least a trigger curve and a stopping limit curve.

24. The method for controlling an elevator system according to claim 22, wherein the predefined safety measures comprise triggering of safety devices as soon as the measured values from the sensors for safely sensing the position and speed of the elevator cab exceed the at least one limit curve or the trigger or stopping limit curve at the respective position in the elevator shaft, so that the elevator cab is stopped within a section of the elevator shaft which is defined by the stopping limit curve.

25. The method for controlling an elevator system according to claim 20, wherein the elevator system is controlled by a bus link and the elevator system comprises a plurality of elevator cabs, wherein each elevator cab is controlled independently of the remaining elevator cars and one of the plurality of the elevator cabs is moved in a respective section of the elevator shaft which is at least currently unused by the other elevator cabs.

26. The method for controlling an elevator system according to claim 25, wherein if the shaft door at a station is not locked then the elevator cab is moved only in a section of the elevator shaft beneath the shaft door which is not locked or the elevator cab is stopped in a region beneath the unlocked shaft door.

27. The method for controlling an elevator system according to claim 25, wherein the plurality of elevator cabs are controlled by calculating limit curves.

28. The method for controlling an elevator system according to claim 27, wherein the control of the elevator cabs comprises collision prevention, with the interval between the plurality of elevator cabs in the elevator shaft being calculated and the at least one limit curve for each elevator cab being calculated in order to prevent elevator cabs from colliding.

29. The method for controlling an elevator system according to claim 20, and further comprising the steps of:

triggering of safety devices of at least one associated elevator cab if the at least one elevator cab loses the connection to the bus link; and moving the remaining elevator cabs to predetermined positions.

* * * * *